US008499856B2

(12) United States Patent
Kumar

(10) Patent No.: US 8,499,856 B2
(45) **Date of Patent: *Aug. 6, 2013**

(54) SMALL CORE GENERATION AND ANALYSIS AT-BIT AS LWD TOOL

(75) Inventor: Sunil Kumar, Celle NDS (DE)

(73) Assignee: Baker Hughes Incorporated, Houston, TX (US)

( * ) Notice: Subject to any disclaimer, the term of this patent is extended or adjusted under 35 U.S.C. 154(b) by 39 days.

This patent is subject to a terminal disclaimer.

(21) Appl. No.: 13/096,484

(22) Filed: Apr. 28, 2011

(65) Prior Publication Data

US 2012/0012393 A1 Jan. 19, 2012

Related U.S. Application Data

(60) Provisional application No. 61/365,665, filed on Jul. 19, 2010.

(51) Int. Cl.
*E21B 25/08* (2006.01)

(52) U.S. Cl.
USPC ..... 175/58; 175/226; 175/244

(58) Field of Classification Search
USPC ..... 175/58, 226, 244, 248, 249
See application file for complete search history.

(56) References Cited

U.S. PATENT DOCUMENTS 2,880,969 A * 4/1959 Williams ..... 175/226
2,973,471 A * 2/1961 Armistead et al. ..... 324/303
3,183,983 A * 5/1965 Vogel ..... 175/44
3,207,239 A * 9/1965 Hugel ..... 175/44
3,241,623 A * 3/1966 Martinez ..... 175/44
3,323,604 A * 6/1967 Henderson ..... 175/244
3,363,703 A * 1/1968 Shewmake ..... 175/44
4,207,954 A 6/1980 Jerome
4,321,968 A * 3/1982 Clear ..... 166/275
4,566,545 A * 1/1986 Story et al. ..... 175/226
4,765,414 A * 8/1988 Moore ..... 175/44
4,875,531 A * 10/1989 Biehl et al. ..... 175/250
4,969,528 A * 11/1990 Jurgens ..... 175/58
4,981,183 A * 1/1991 Tibbitts ..... 175/244
5,038,873 A 8/1991 Jurgens
5,310,013 A * 5/1994 Kishino et al. ..... 175/44
5,360,074 A 11/1994 Collee et al.
5,560,438 A * 10/1996 Collee et al. ..... 175/58
5,881,825 A * 3/1999 Collee et al. ..... 175/58
5,980,628 A * 11/1999 Hjelmeland et al. ..... 106/778
5,984,023 A 11/1999 Sharma et al.
6,003,620 A 12/1999 Sharma et al.
6,006,844 A 12/1999 Van Puymbroeck et al.
6,220,371 B1 4/2001 Sharma et al.
6,388,251 B1 5/2002 Papanyan (Continued)

*Primary Examiner* — Daniel P Stephenson
(74) *Attorney, Agent, or Firm* — Mossman, Kumar & Tyler, PC

(57) ABSTRACT

The present disclosure is related to an apparatus for taking a sample in a wellbore during drilling operations. The apparatus may include a drill bit configured to form a core and at least one retractable cutter internal to the drill bit for taking the sample from the core. The apparatus may also include equipment for analyzing the sample, extracting fluid from the sample, testing fluid from the sample, encapsulating the sample, and/or tagging the sample. The present disclosure is also related to a method for taking a core sample without interrupting drilling operations. The method includes taking a core sample using a drill bit configured to take a core sample using internal cutters. The method may also include analyzing the sample, extracting fluid from the sample, analyzing fluid from the sample, encapsulating the sample, and/or tagging the sample.

11 Claims, 9 Drawing Sheets

U.S. PATENT DOCUMENTS

| | | | | |
|---|---|---|---|---|
| 6,457,538 | B1 | 10/2002 | Pittard et al. | |
| 6,788,066 | B2 | 9/2004 | Wisler et al. | |
| 7,124,841 | B2 * | 10/2006 | Wada et al. | 175/226 |
| 7,168,508 | B2 | 1/2007 | Goldberg et al. | |
| 7,293,613 | B2 | 11/2007 | Goldberg et al. | |
| 7,293,715 | B2 * | 11/2007 | Bargach et al. | 235/492 |
| 7,500,388 | B2 | 3/2009 | Fujisawa et al. | |
| 7,733,093 | B2 | 6/2010 | Homan et al. | |
| 8,011,454 | B2 * | 9/2011 | Castillo | 175/249 |
| 8,081,802 | B2 * | 12/2011 | Dvorkin et al. | 382/109 |
| 2001/0050559 | A1 | 12/2001 | Wisler et al. | |
| 2002/0139583 | A1 * | 10/2002 | Masui et al. | 175/58 |
| 2005/0194134 | A1 * | 9/2005 | McGregor et al. | 166/264 |
| 2006/0054358 | A1 * | 3/2006 | Hill et al. | 175/58 |
| 2007/0282533 | A1 * | 12/2007 | Parfitt | 702/2 |
| 2008/0066534 | A1 | 3/2008 | Reid et al. | |
| 2009/0078467 | A1 * | 3/2009 | Castillo | 175/249 |
| 2009/0166088 | A1 | 7/2009 | Jeffryes et al. | |
| 2010/0324868 | A1 * | 12/2010 | Russell et al. | 703/1 |
| 2012/0012392 | A1 * | 1/2012 | Kumar | 175/58 |
| 2012/0012393 | A1 * | 1/2012 | Kumar | 175/58 |

* cited by examiner

SMALL CORE GENERATION AND ANALYSIS AT-BIT AS LWD TOOL

CROSS-REFERENCES TO RELATED APPLICATIONS

This application claims priority from U.S. Provisional Patent Application Ser. No. 61/365,665, filed on 19 Jul. 2010.

FIELD OF THE DISCLOSURE

This disclosure generally relates to the testing and sampling of underground formations or reservoirs. More specifically, this disclosure relates to preparing a core sample without interrupting drilling operations, and, in particular, processing the core sample for analysis of fluids using extraction and/or encapsulation methods and apparatuses.

BACKGROUND OF THE DISCLOSURE

Hydrocarbons, such as oil and gas, often reside in porous subterranean geologic formations. Often, it can be advantageous to use a coring tool to obtain representative samples of rock taken from the wall of the wellbore intersecting a formation of interest. Rock samples obtained through vertical and side wall coring are generally referred to as "core samples." Analysis and study of core samples enables engineers and geologists to assess important formation parameters such as the reservoir storage capacity (porosity), the flow potential (permeability) of the rock that makes up the formation, the composition of the recoverable hydrocarbons or minerals that reside in the formation, and the irreducible water saturation level of the rock. These estimates are crucial to subsequent design and implementation of the well completion program that enables production of selected formations and zones that are determined to be economically attractive based on the data obtained from the core sample Coring typically requires drilling to be stopped after a core sample is formed, so that the core sample may be brought to the surface. Core samples are often tested after being brought to the surface, however, travel to the surface may result in contamination of or damage to the core samples as they travel to the surface. The drilling stoppage takes time and effort that could be reduced if drilling could continue while core samples were taken. It would be advantageous to perform uninterrupted drilling while coring. It would also be advantageous to perform testing on core samples in situ without requiring travel to the surface or to protect core samples from encounters with damaging objects and contaminating fluids while traveling to the surface. The present disclosure provides apparatuses and methods for preparing core samples for in situ analysis and/or protecting the core samples for travel to the surface while drilling remains uninterrupted.

SUMMARY OF THE DISCLOSURE

In aspects, the present disclosure generally relates to the testing and sampling of underground formations or reservoirs. More specifically, this disclosure relates to preparing a core sample without interrupting drilling operations, and, in particular, processing the core sample for analysis of fluids using extraction and/or encapsulation methods and apparatuses.

One embodiment according to the present disclosure may include an apparatus for forming a sample in a wellbore, comprising: a drill bit configured to form a core; and at least one retractable cutter internal to the drill bit configured to cut the sample from the core.

Another embodiment according to the present disclosure may include an apparatus for encapsulating a sample in a wellbore, comprising: a drill bit configured to form a core; a chamber configured to receive the sample from the core; and an encapsulater operably coupled to the chamber and configured to at least partially encapsulate at least part of the sample in an encapsulating material.

Another embodiment according to the present disclosure may include a method of taking a sample in a wellbore, comprising: using a drill bit conveyed into the wellbore to form a core; and using at least one retractable cutter internal to the drill bit for cutting the sample from the core.

Another embodiment according to the present disclosure may include a method for encapsulating a sample in a wellbore, comprising: using a drill bit in the wellbore for forming a core; using a retractable cutter internal to the drill bit for cutting a sample from the core and conveying the sample to a receiving chamber; and using an encapsulater operably coupled to the receiving chamber for at least partially encapsulating at least part of the sample in an encapsulating material.

Examples of the more important features of the disclosure have been summarized rather broadly in order that the detailed description thereof that follows may be better understood and in order that the contributions they represent to the art may be appreciated.

BRIEF DESCRIPTION OF THE DRAWINGS

For a detailed understanding of the present disclosure, reference should be made to the following detailed description of the embodiments, taken in conjunction with the accompanying drawings, in which like elements have been given like numerals, wherein.

DETAILED DESCRIPTION

Figure 1:
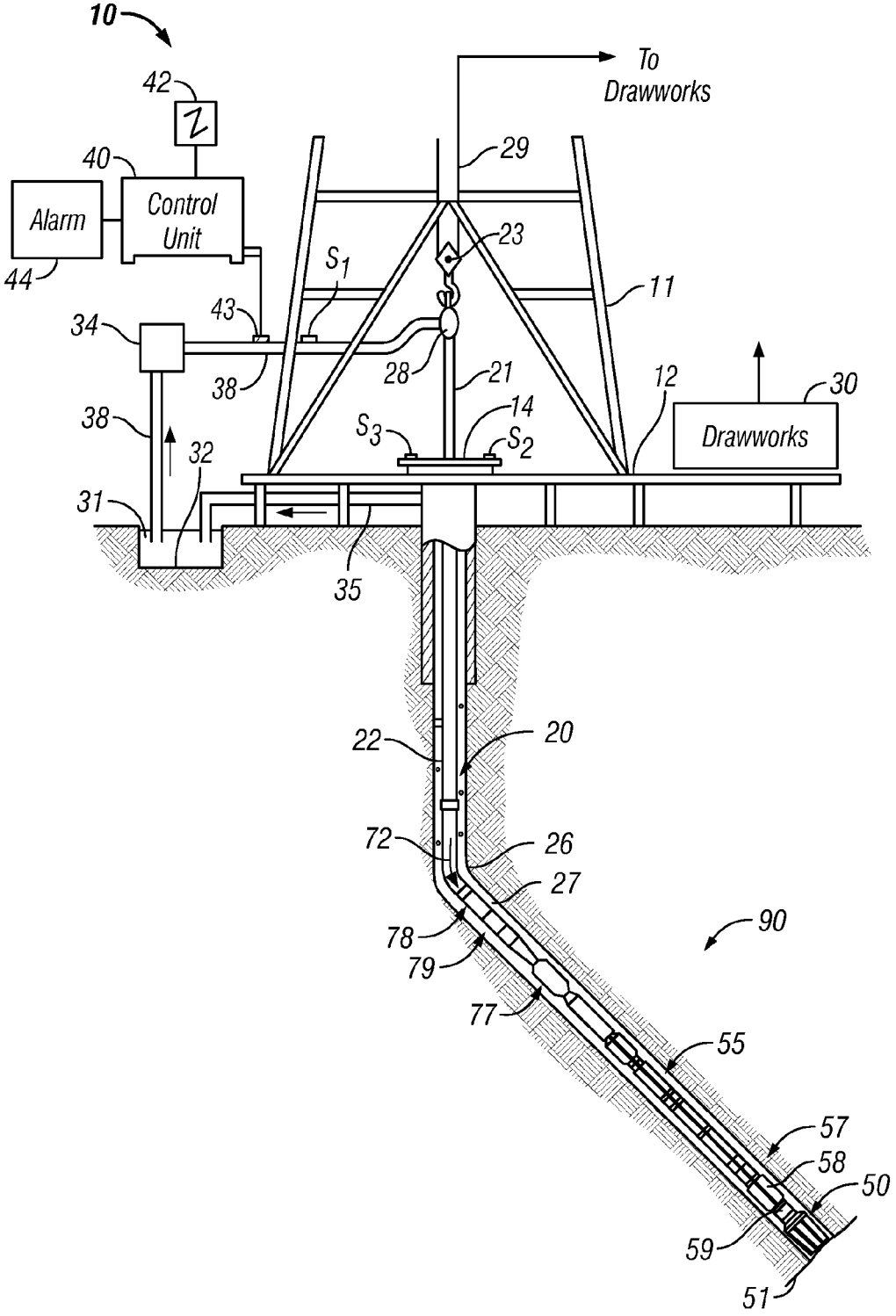
FIG. 1 shows a schematic of a coring drill bit deployed in a borehole along a according to one embodiment of the present disclosure.

This disclosure generally relates to the testing and sampling of underground formations or reservoirs. In one aspect, this disclosure relates to preparing a core sample without interrupting drilling operations, and, in another aspect, to processing the core sample for analysis of fluids using extraction or encapsulation methods and apparatuses. The present disclosure is susceptible to embodiments of different forms. There are shown in the drawings, and herein will be described in detail, specific embodiments of the present disclosure with the understanding that the present disclosure is to be considered an exemplification of the principles of the disclosure, and is not intended to limit the disclosure to that illustrated and described herein. Indeed, as will become apparent, the teachings of the present disclosure can be utilized for a variety of well tools and in all phases of well construction and production. Accordingly, the embodiments discussed below are merely illustrative of the applications of the present invention.

FIG. 1 shows a schematic diagram of an exemplary drilling system 10 with a drill string 20 carrying a drilling assembly 90 (also referred to as the bottomhole assembly, or "BHA") conveyed in a "wellbore" or "borehole" 26 for drilling the borehole. The drill string 20 may include one or more of: jointed tubular and coiled tubing. The drilling system 10 includes a conventional derrick 11 erected on a floor 12 which supports a rotary table 14 that is rotated by a prime mover such as an electric motor (not shown) at a desired rotational speed. The drill string 20 includes tubing such as a drill pipe 22 or a coiled-tubing extending downward from the surface into the borehole 26. The drill string 20 is pushed into the borehole 26 when a drill pipe 22 is used as the tubing. For coiled-tubing applications, a tubing injector, such as an injector (not shown), however, is used to move the tubing from a source thereof, such as a reel (not shown), to the borehole 26. The drill bit assembly 50 attached to the end of the drill string breaks up the geological formations when it is rotated to drill the borehole 26. If a drill pipe 22 is used, the drill string 20 is coupled to a drawworks 30 via a kelly joint 21, swivel 28, and line 29 through a pulley 23. During drilling operations, the drawworks 30 is operated to control the weight on bit, which is an important parameter that affects the rate of penetration. The operation of the drawworks is well known in the art and is thus not described in detail herein.

During drilling operations, a suitable drilling fluid 31 from a mud pit (source) 32 is circulated under pressure through a channel in the drill string 20 by a mud pump 34. The drilling fluid passes from the mud pump 34 into the drill string 20 via a desurger (not shown), fluid line 38 and kelly joint 21. The drilling fluid 31 is discharged at the borehole bottom 51 through an opening in the drill bit assembly 50. The drilling fluid 31 circulates uphole through the annular space 27 between the drill string 20 and the borehole 26 and returns to the mud pit 32 via a return line 35. The drilling fluid acts to lubricate the drill bit assembly 50 and to carry borehole cutting or chips away from the drill bit assembly 50. A sensor S1 placed in the line 38 can provide information about the fluid flow rate. A surface torque sensor S2 and a sensor S3 associated with the drill string 20 respectively provide information about the torque and rotational speed of the drill string. Additionally, a sensor (not shown) associated with line 29 is used to provide the hook load of the drill string 20.

In one embodiment of the disclosure, the drill bit assembly 50 is rotated by only rotating the drill pipe 22. In another embodiment of the disclosure, a downhole motor 55 (mud motor) is disposed in the drilling assembly 90 to rotate the drill bit assembly 50 and the drill pipe 22 is rotated usually to supplement the rotational power, if required, and to effect changes in the drilling direction.

In one embodiment of FIG. 1, the mud motor 55 is coupled to the drill bit assembly 50 via a drive shaft (not shown) disposed in a bearing assembly 57. The mud motor rotates the drill bit assembly 50 when the drilling fluid 31 passes through the mud motor 55 under pressure. The bearing assembly 57 supports the radial and axial forces of the drill bit assembly. A stabilizer 58 coupled to the bearing assembly 57 acts as a centralizer for the lowermost portion of the mud motor assembly.

In one embodiment of the disclosure, a drilling sensor module 59 is placed near the drill bit assembly 50. Drill bit assembly 50 may include one or more of: (i) a drill bit, (ii) a drill bit box, (iii) a drill collar, and (iv) a storage sub. The drilling sensor module may contain sensors, circuitry, and processing software and algorithms relating to the dynamic drilling parameters. Such parameters can include bit bounce, stick-slip of the drilling assembly, backward rotation, torque, shocks, borehole and annulus pressure, acceleration measurements, and other measurements of the drill bit assembly condition. A suitable telemetry or communication sub 77 using, for example, two-way telemetry, is also provided as illustrated in the drilling assembly 90. The drilling sensor module processes the sensor information and transmits it to the surface control unit 40 via the communication sub 77.

The communication sub 77, a power unit 78 and an MWD tool 79 are all connected in tandem with the drill string 20. Flex subs, for example, are used in connecting the MWD tool 79 in the drilling assembly 90. Such subs and tools may form the bottom hole drilling assembly 90 between the drill string 20 and the drill bit assembly 50. The drilling assembly 90 may make various measurements including the pulsed nuclear magnetic resonance measurements while the borehole 26 is being drilled. The communication sub 77 obtains the signals and measurements and transfers the signals, using two-way telemetry, for example, to be processed on the surface. Alternatively, the signals can be processed using a downhole processor at a suitable location (not shown) in the drilling assembly 90.

The surface control unit or processor 40 may also receive one or more signals from other downhole sensors and devices and signals from sensors $S_1$-$S_3$ and other sensors used in the system 10 and processes such signals according to programmed instructions provided to surface control unit 40. The surface control unit 40 may display desired drilling parameters and other information on a display/monitor 44 utilized by an operator to control the drilling operations. The surface control unit 40 can include a computer or a microprocessor-based processing system, memory for storing programs or models and data, a recorder for recording data, and other peripherals. The control unit 40 can be adapted to activate alarms 42 when certain unsafe or undesirable operating conditions occur.

The apparatus for use with the present disclosure may include one or more downhole processors that may be positioned at any suitable location within or near the bottom hole assembly. The processor(s) may include a microprocessor that uses a computer program implemented on a suitable machine readable medium that enables the processor to perform the control and processing. The machine readable medium may include ROMs, EPROMs, EAROMs, EEPROMs, Flash Memories, RAMs, Hard Drives and/or Optical disks. Other equipment such as power and data buses, power supplies, and the like will be apparent to one skilled in the art.

Figure 2:
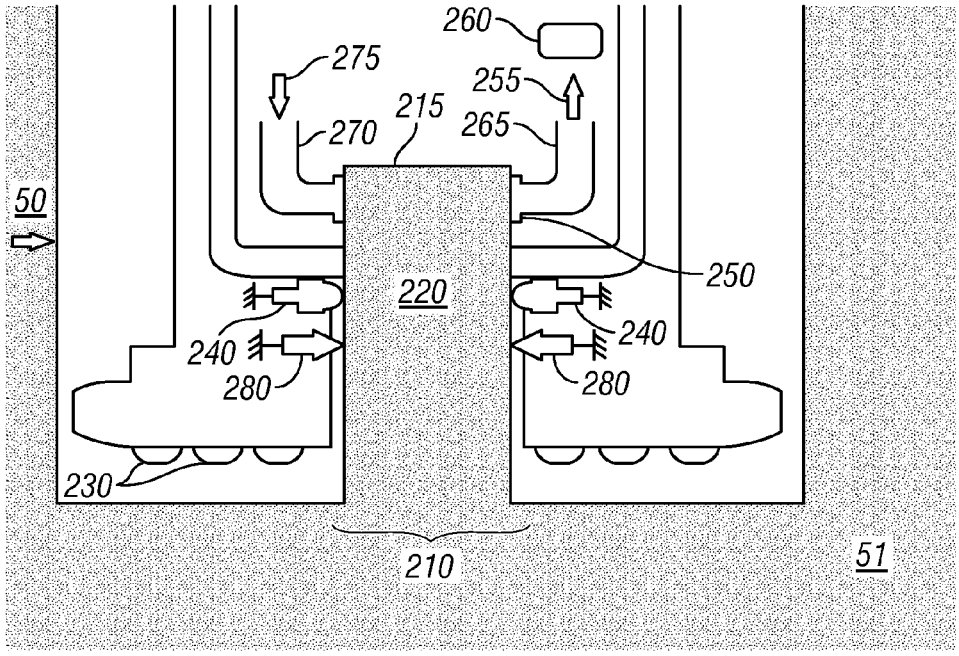
FIG. 2 shows a schematic of a drill bit configured for testing core sample fluids according to one embodiment of the present disclosure.

FIG. 2 shows an exemplary embodiment of drill bit assembly 50 configured for generating a core sample that may be tested in situ. The drill bit assembly 50 may include a core mouth 210 configured to receive a core sample 220 of material from the borehole bottom 51. The core sample 220 may be formed by the teeth 230 of drill bit assembly 50. Drill bit assembly 50 may include a recessed section or chamber 215 configured to store core sample 220. Within chamber 215, drill bit assembly 50 may include retractable cutters 280 to separate the core sample 220 from the formation 51. One or more seals 240 may be configured to hold core sample 220 and may isolate the core sample 220 within chamber 215. A probe 250 may be used to extract fluid 255 from the core sample 220. The extracted fluid 255 may be transported to a fluid analysis module 260 by a tube 265. The extracted fluid 255 may be forced into tube 265 by pressurized fluid 275 being applied to core sample 220 through a pressurized tube 270 that may be configured to apply pressure on the core sample 220. The use of pressurized fluid to extract fluid from the core sample is exemplary and illustrative only, as other devices may be used to extract fluid, including, but not limited to, one or more of: (i) an acoustic driver (an ultrasonic driver is one type of acoustic driver) and (ii) a mechanical crusher. In some embodiments, a filter may be incorporated into drill bit assembly 50 so that the core sample 220 may be crushed, smashed, and/or pulverized, and then the remains may be filtered to extract the fluids 255. Fluid 255 may be a fluid including, but not limited to, one or more of: (i) drilling fluid, (ii) production fluid, and (iii) formation fluid. Fluid analysis module 260 may include sensors or test equipment configured to estimate chemical, physical, electrical, and/or nuclear properties of the extracted fluid 255, including, but not limited to, one or more of: (i) pH, (ii) $H_2S$, (iii) density, (iv) viscosity, (v) temperature, (vi) rheological properties, (vii) thermal conductivity, (viii) electrical resistivity, (ix) chemical composition, (x) reactivity, (xi) radiofrequency properties, (xii) surface tension, (xiii) infra-red absorption, (xiv) ultraviolet absorption, (xv) refractive index, (xvi) magnetic properties, and (xvii) nuclear spin. In some embodiments, the drill bit assembly 50 may use the device used to apply pressure to the core sample 220 or an additional mechanism (not shown) applying pressure to the core sample 220 such that rock mechanics tests may be performed on the core sample 220 in-situ. Rock mechanics tests may include, but are not limited to, one or more of: (i) a compression test, (ii) a strain test, and (iii) a fracture test. Further, in some embodiments, testing data obtained through rock mechanics tests may be used to modify and/or optimize drilling parameters. Modification and/or optimization of drilling parameters, (such as, but not limited to, weight on bit, rotational speed of the drill bit, flow rate of drilling fluid, and geosteering parameters) may be determined downhole or at the surface, and modification of drilling parameters may take place in real-time.

Figure 3:
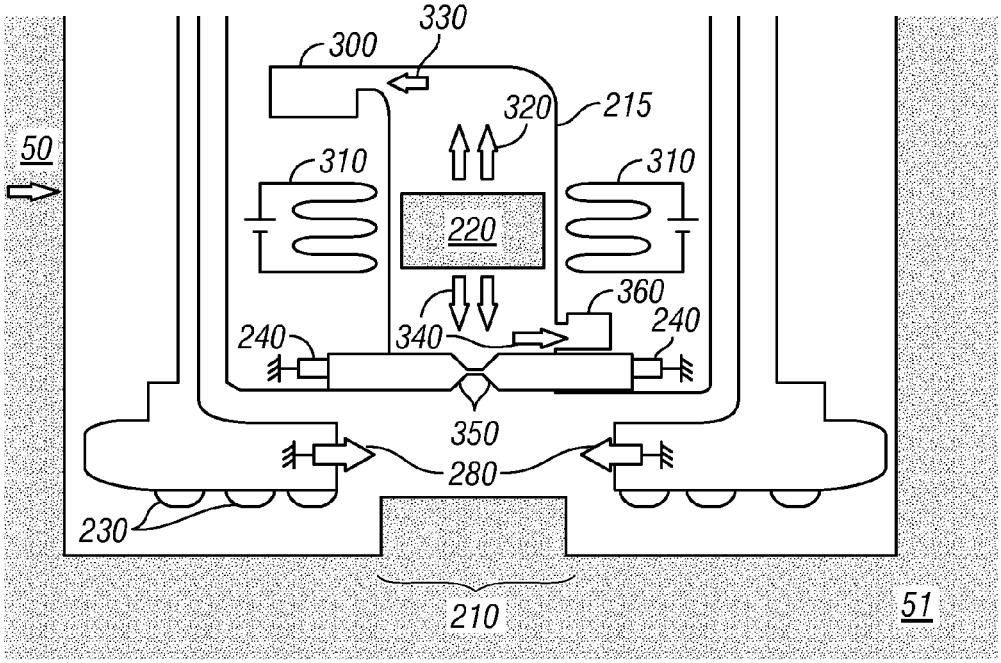
FIG. 3 shows a schematic of another drill bit configured for testing core sample fluids according to one embodiment of the present disclosure.

FIG. 3 shows another exemplary embodiment of drill bit assembly 50 configured to use a gas chromatograph 300. Core sample 220 may be heated by heater 310 to a desired temperature to cause gases 320 to be generated. Heater 310 may heat core sample 220 using, but not limited to, one or more of: (i) electric induction, (ii) radiative heating, and (iii) electrical resistive heating. Heater 310 may be controlled to operate at various temperatures to provide a variety of gas samples 320 to the gas chromatograph 300. The gases 320 may be directed from chamber 215 into gas chromatograph 300 via a connecting tube 330. The heating of the core sample 220 may also result in the release of fluids 340 from the core sample 220. These fluids 340 may flow along the bottom 350 of chamber 215 into a heavy fluid analysis module 360. The bottom 350 may be formed by the top of the seals 240 or a separate isolation barrier (not shown). Heavy fluid analysis module 360 may include sensors or test equipment configured to estimate chemical, physical, and/or nuclear properties of the fluids 340, including, but not limited to, one or more of: (i) pH, (ii) $H_2S$, (iii) density, (iv) viscosity, (v) temperature, (vi) rheological properties, (vii) thermal conductivity, (viii) electrical resistivity, (ix) chemical composition, (x) reactivity, (xi) radiofrequency properties, (xii) surface tension, (xiii) infra-red absorption, (xiv) ultraviolet absorption, (xv) refractive index, (xvi) magnetic properties, and (xvii) nuclear spin.

Figure 4:
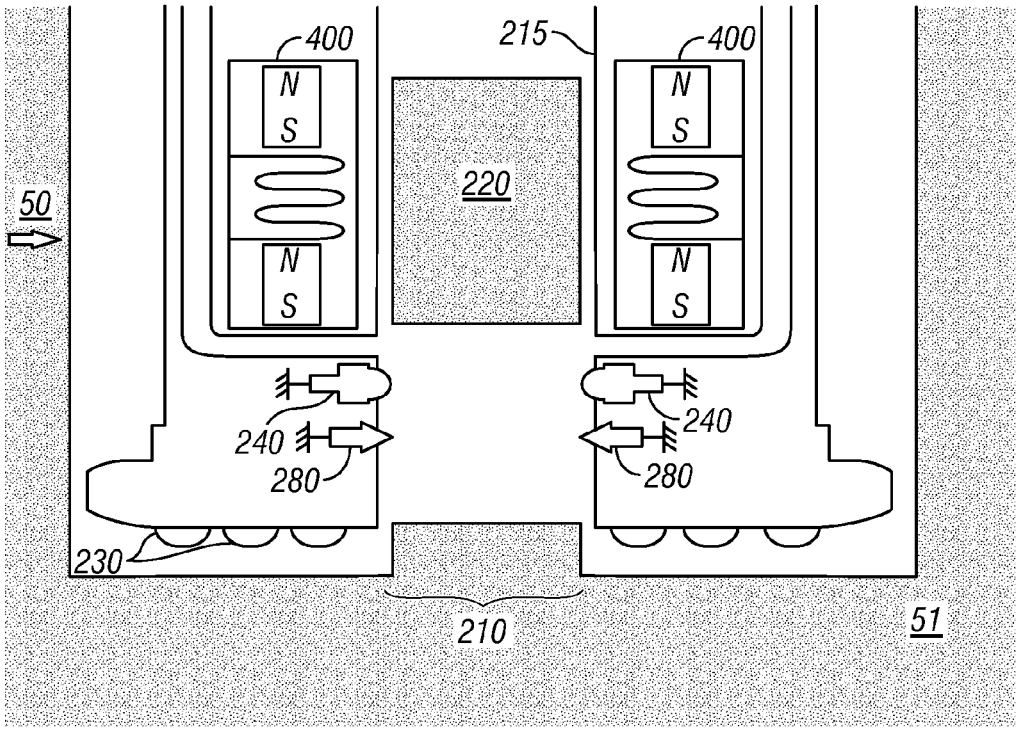
FIG. 4 shows a schematic of a drill bit configured for testing a core sample according to one embodiment of the present disclosure.

FIG. 4 shows another exemplary embodiment of drill bit assembly 50 configured to expose the core sample 220 within chamber 215 to a strong magnetic field from a nuclear magnetic resonance (NMR) module 400. The NMR module 400 may be equipped to generate a strong magnetic field and to detect a response of the core sample 220 to the strong magnetic field. The NMR module 400 may be controlled to regulate the power of the magnetic field being applied to the core sample 220. In some embodiments, the drill bit assembly 50 may be equipped with a radio frequency generator and/or receiver configured to apply a radio signal to the core sample 220 and detect a radio frequency response caused by the interaction of the radio signal with the core sample 220.

Figure 5:
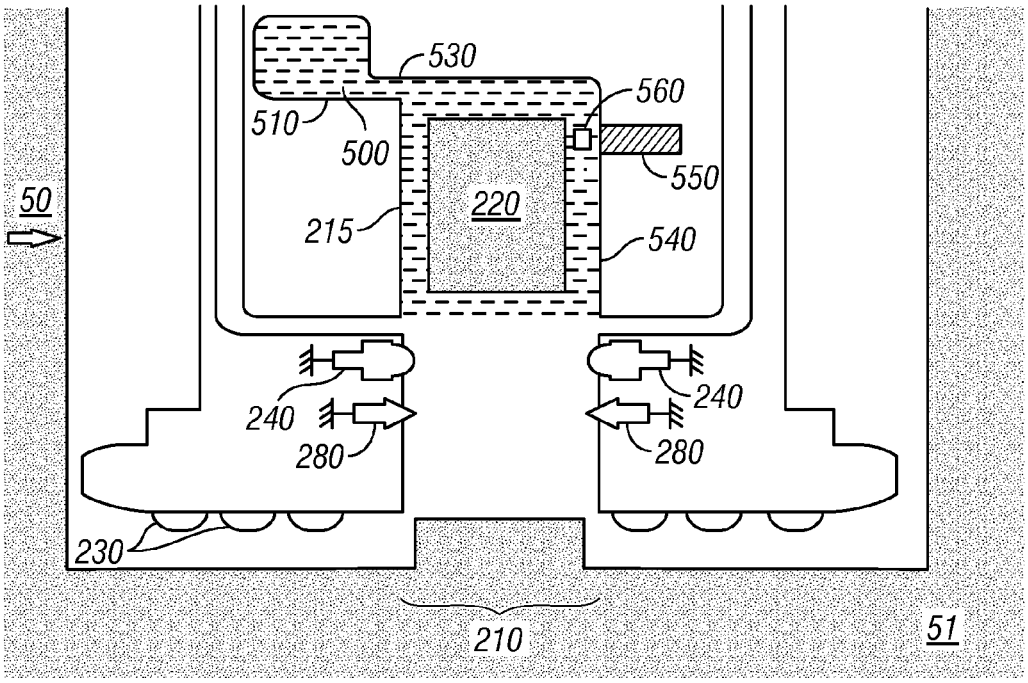
FIG. 5 shows a schematic of a drill bit configured for protecting a core sample according to one embodiment of the present disclosure.

FIG. 5 shows another exemplary embodiment of drill bit assembly 50 configured to at least partially encapsulate a core sample 220 in a chamber 215 with an encapsulating material 500. The chamber 215 may include one or more retractable cutters 280 configured to separate the core sample 220 from the borehole bottom 51. Within the drill bit assembly 50 may be a reservoir 510 to store encapsulating material 500. Once a core sample 220 is within the chamber 215 and isolated from the borehole bottom 51, the encapsulating material 500 may be applied to the core sample 220. A tube 530 may allow the encapsulating material 500 to flow from the reservoir 510 and into chamber 215. Once in contact with the core sample 220 the encapsulating material 500 forms an encapsulating coating 540 that at least partially surrounds core sample 220. Drill bit assembly 50 may also include a tagging device 550 with access to chamber 215. Tagging device 550 may be configured to insert or implant a tag 560 (such as a radio frequency identification device (RFID) chip) within the encapsulating coating 540 so that a core sample may be identified. In some embodiments, the tagging device 550 may be configured to etch or mark an identifier on the core sample 220 or on the encapsulating coating 540. The tagging device may include, but is not limited to, one of: (i) a laser marker, (ii) an ultrasonic blasting tool, (iii) a powder blasting tool, (iv) radioactive tracers, (v) magnetic particles, and (vi) a chip inserter. The encapsulating material 500 may include, but is not limited to, one or more of: (i) a polymer, (ii) a gel, (iii) a metallic coating, and (iv) a clay.

Figure 6:
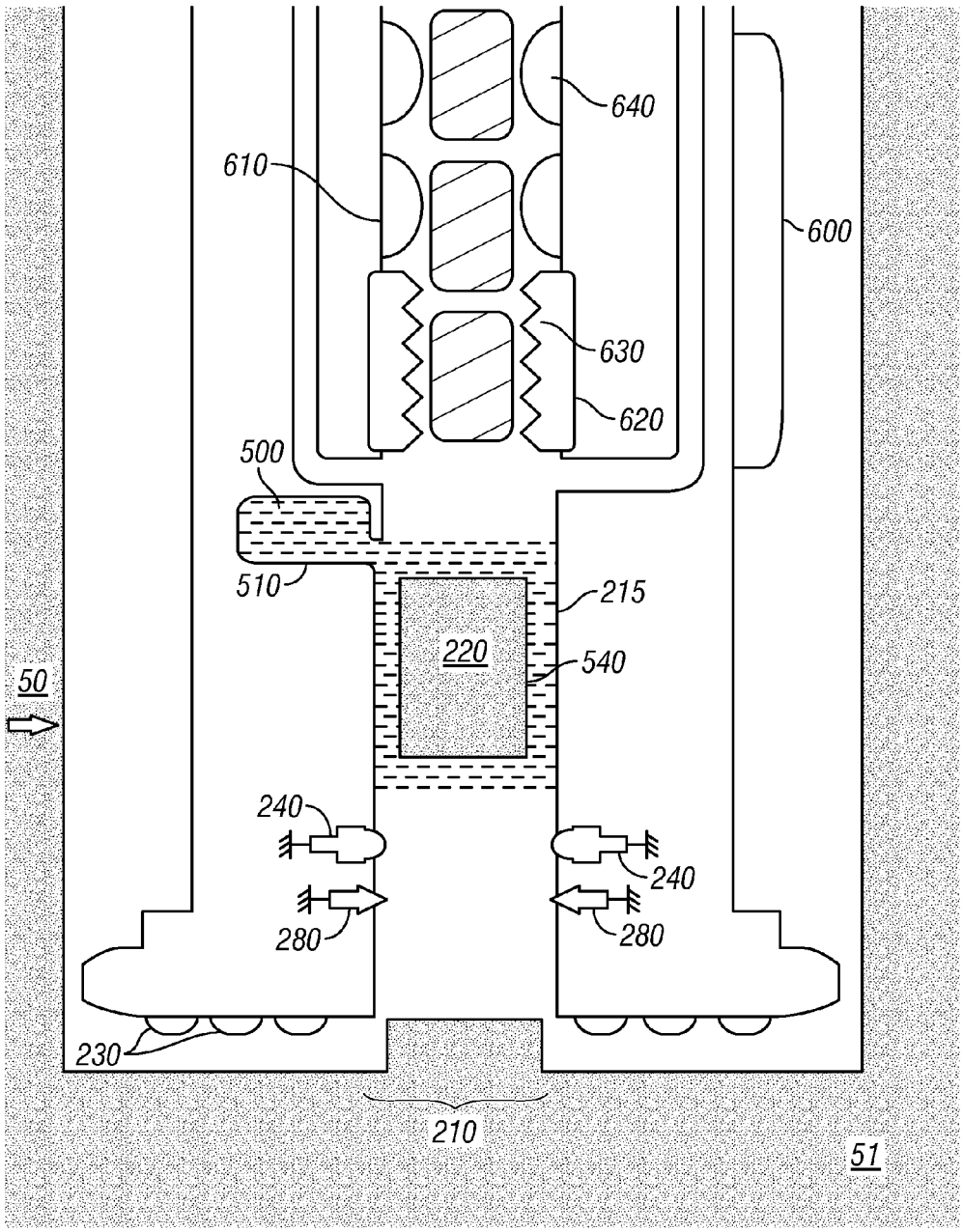
FIG. 6 shows a schematic of a drill bit configured for protecting and storing a core sample according to one embodiment of the present disclosure.

FIG. 6 shows another exemplary embodiment of drill bit assembly 50 configured with a storage module 600 for storing one or more core samples 220. The storage module 600 may include a storage chamber 610 that is configured to receive a core sample 220 from the chamber 215. The storage module may also include a transporter 620 located within storage chamber 610 configured to grip or hold the core sample 220 for conveyance into and/or within the storage chamber 610. The transporter 620 may include a series of teeth 630 configured to grip or hold the core sample 220 so that it may be moved deeper within the storage chamber 610. The storage module 600 may also include bellows or bladders 640 configured to hold core samples 220 firmly within the deeper recesses of the storage chamber 610, which may allow multiple sample cores 220 to be stored within the storage chamber 610. The bellows 640 and/or the teeth 630 may be configured to minimize the chance of the encapsulating coating 540 being damaged by the transport or storage of the core sample 220. In some embodiments (not shown) the storage module may be located behind the drill bit assembly in the bit shank or a sub. While a transporter 620 is shown with mechanical teeth 630, this is illustrative and exemplary only, as transporter 620 may use any device known to those of skill in the art to move the core sample 220 within the chambers 215, 610, including, but not limited to, (i) gears, (ii) a helical drive, (iii) a spiral drive, (iv) a piston, and (v) a robotic arm.

Figure 7A:
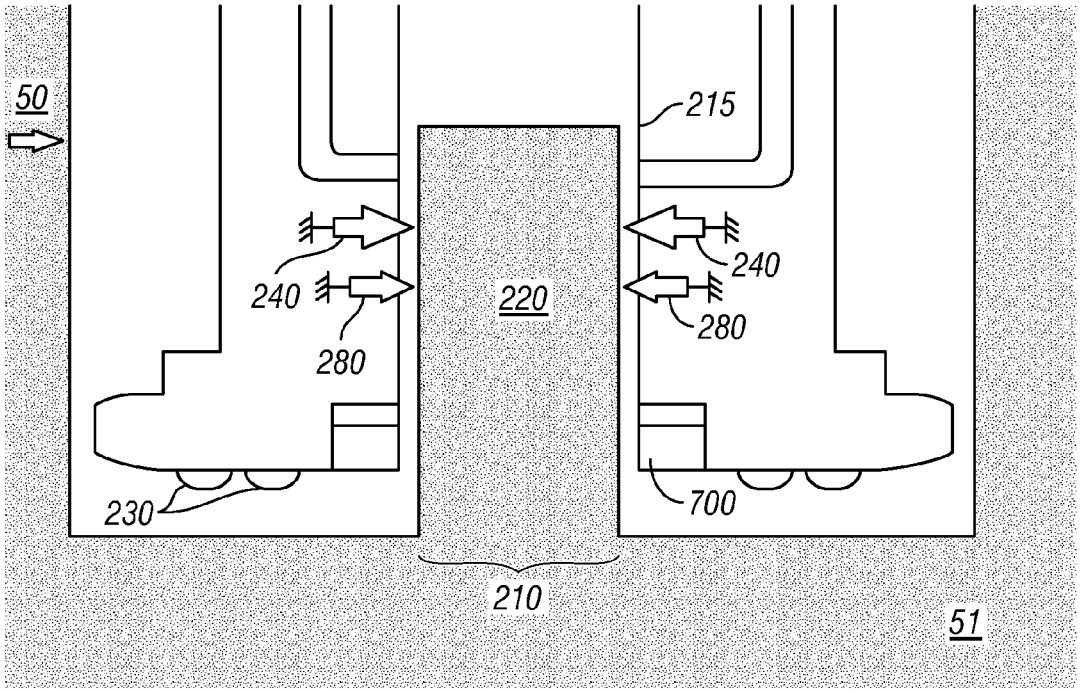
FIG. 7A shows a schematic of a drill bit configured for cutting a core sample according to one embodiment of the present disclosure.

FIG. 7A shows an exemplary drill bit assembly 50 equipped with core cutters 700 in addition to the drill bit teeth 230. The core cutters may be located adjacent to the core mouth 210. The core cutters 700 may include, but are not limited to, one of: (i) elongated cutting blades, (ii) ultrasonic cutters, (iii) acoustic ablators, (iv) fluid blasters, (v) powder blasters, and (vi) laser cutters.

Figure 7B:
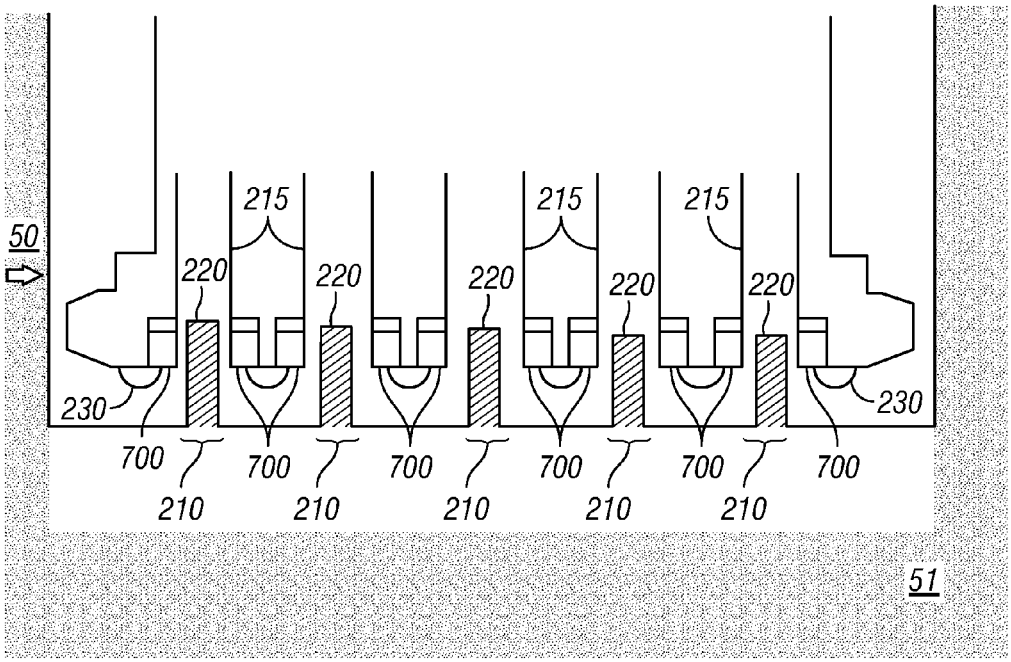
FIG. 7B shows a schematic of a drill bit configured for cutting multiple core samples according to one embodiment of the present disclosure.

FIG. 7B shows an exemplary drill bit assembly 50 configured to cut multiple core samples 220. The face of the drill bit assembly 220 may includes core mouths 210 that open into multiple sample chambers 215. One or more of the core mouths 210 may have core cutters 700 mounted adjacent to the core mouth 210 on the drill bit assembly 50. In operation, individual or multiple core samples 220 may be received by the core chamber 215 by controlling which core cutters 700 are in operation.

While FIGS. 2-7B show various embodiments according to the present disclosure with individual features, some or all of these may be combined to form a drill bit assembly configured to perform one or more tests and to encapsulate a core sample 220. Some embodiments may be configured to allow collection of multiple core samples where some core samples have fluid extraction, others have fluids extracted and tested, and still others are encapsulated with or without prior testing. While various embodiments are shown for forming a core sample in front of the drill bit assembly, this is illustrative and exemplary only; as embodiments of the present disclosure include apparatus to take side core samples as well.

Figure 8:
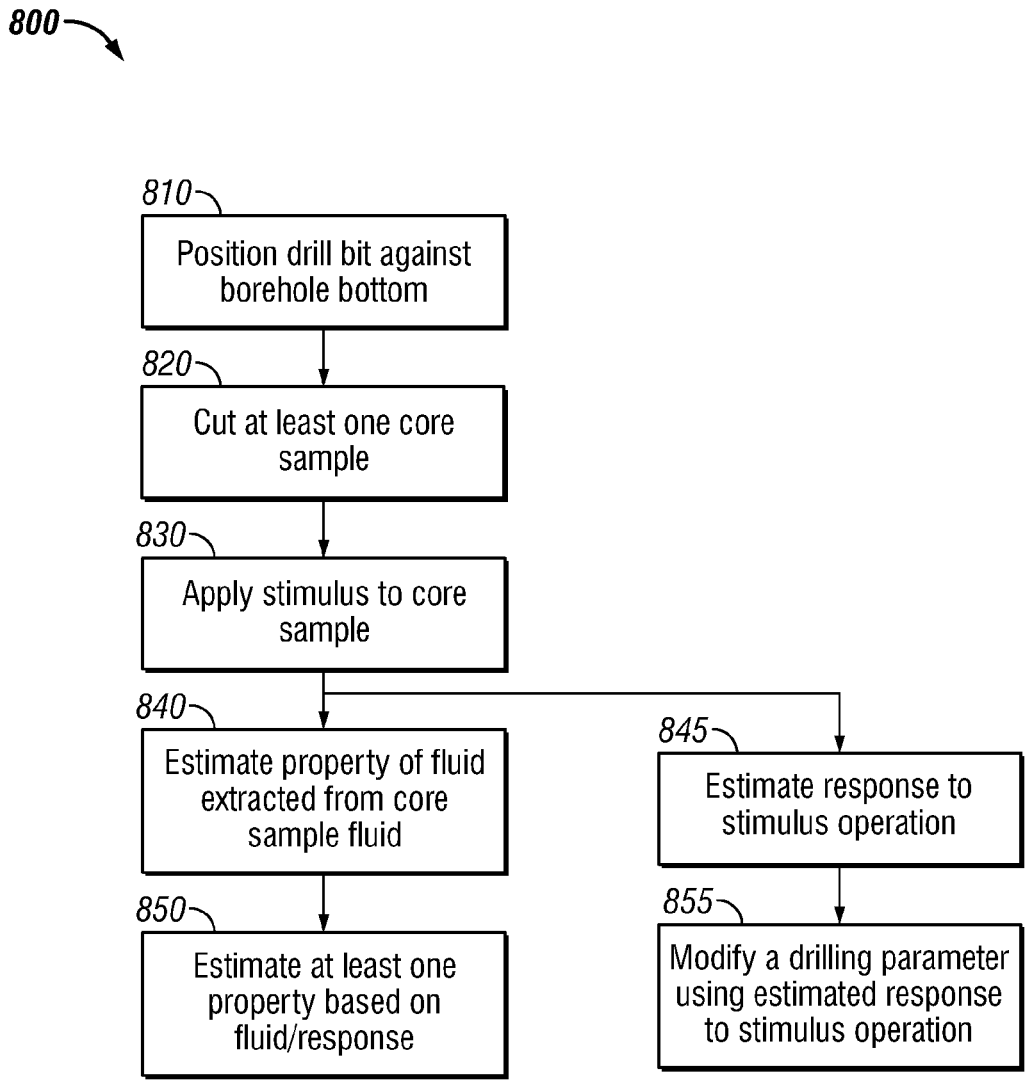
FIG. 8 shows a flow chart of a method for analyzing a fluid from a core sample in situ according to one embodiment of the present disclosure.

FIG. 8 shows an exemplary method 800 according to one embodiment of the present disclosure for testing the core sample or fluids derived from the core sample. In method 800, drill bit assembly 50 may be positioned against borehole bottom 51 within borehole 26 in step 810. In step 820, at least one core sample 220 may be cut from borehole bottom 51 using drill bit teeth 230 or specialized core cutters 700 and received into the chamber 215 through core mouth 210. In some embodiments, multiple core samples 220 may be cut simultaneously during step 820. In step 830, a stimulus may be applied to the core sample 220. The stimulus applied to the core sample 220 may include, but is not limited to, one or more of: (i) pressure, (ii) heat, (iii) acoustic energy, (iv) a magnetic field, and (v) electromagnetic radiation. In step 840, liquid or gaseous fluids 255, 320, 340 from the core sample 220 may be tested to estimate at least one chemical, physical, electrical, and/or nuclear property, including, but not limited to, one or more of: (i) pH, (ii) $H_2S$, (iii) density, (iv) viscosity, (v) temperature, (vi) rheological properties, (vii) thermal conductivity, (viii) electrical resistivity, (ix) chemical composition, (x) reactivity, (xi) radiofrequency properties, (xii) surface tension, (xiii) infra-red absorption, (xiv) ultraviolet absorption, (xv) refractive index, (xvi) magnetic properties, and (xvii) nuclear spin. In step 845, the core sample 220 may be tested for its response to exposure to one or more of: (i) a magnetic field, (ii) radio frequency energy, (iii) electromagnetic radiation, (iv) an electric field, (v) temperature, (vi) density, (vii) resistivity properties, (viii) acoustic radiation, and (ix) pressure. Step 840, step 845, or both may be performed in different embodiments of method 800. In step 850, the at least one property estimated in one or both of step 840 and step 845, may be used to estimate a parameter of interest of the formation at the bottom of the borehole 51. In some embodiments, step 855 may be performed such that the response to stimulus obtained in step 845 may be used to modify at least one drilling parameter. Step 855 may be performed in real-time.

Figure 9:
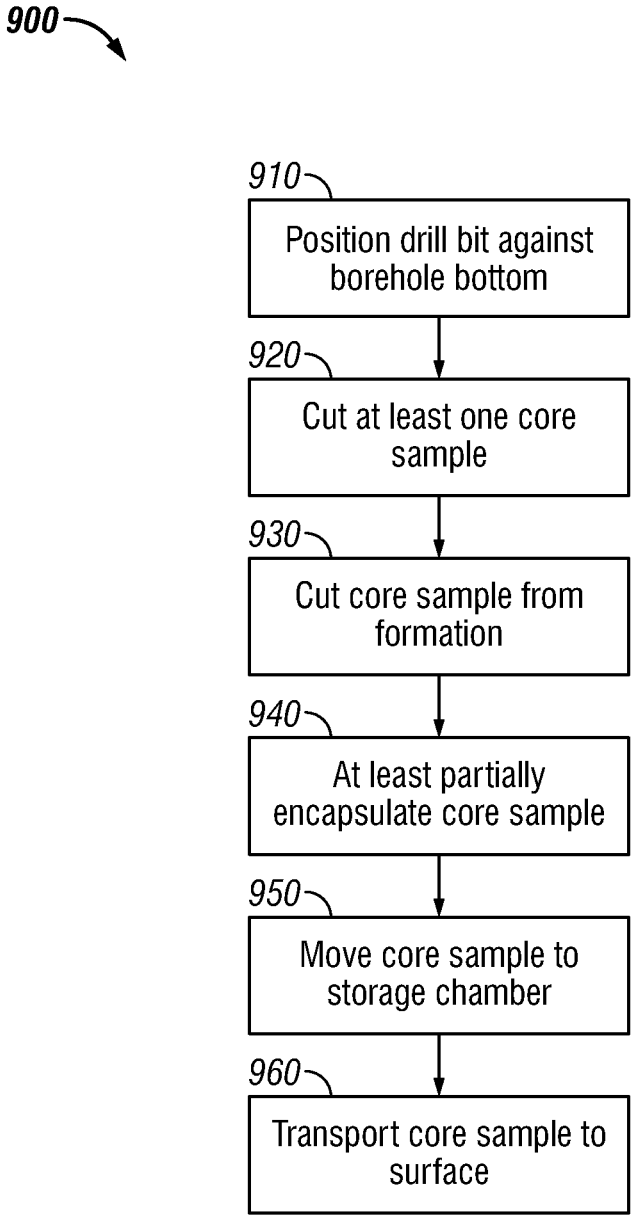
FIG. 9 shows a flow chart of a method for protecting a core sample for transport according to one embodiment of the present disclosure.

FIG. 9 shows an exemplary method 900 according to one embodiment of the present disclosure for encapsulating the core sample. In method 900, drill bit assembly 50 may be positioned against borehole bottom 51 within borehole 26 in step 910. In step 920, at least one core sample 220 may be cut from borehole bottom 51 using drill bit teeth 230 or specialized core cutters 700 and received into the chamber 215 through core mouth 210. In some embodiments, multiple core samples 220 may be cut simultaneously during step 920. In step 930, the core sample 220, may be pinched off or separated from the formation by retractable cutters 280. In step 940, core sample 220 may be at least partially encapsulated by an encapsulating coating 540 provided from a reservoir 510 of encapsulating material 500. The encapsulating process may include, but is not limited to, one of: (i) spraying, (ii) immersing partially, (iii) immersing completely, (iv) pouring, (v) wrapping, and (vi) thermal evaporation coating. In step 950, core sample 220 may be moved from chamber 215 to a storage chamber 610 by transporter 620. In step 960, the drill bit assembly 50 may be transported to the surface for retrieval of the core samples 220. In some embodiments, step 950 may be optional. In some embodiments, prior to, during, or immediately after encapsulation, a tagging device may attach an identification tag to the core sample 220. In other embodiments, the tagging device may etch or mark the sample or the encapsulating coating with an identifier. The tagging device may include, but is not limited to, one of: (i) a laser marker, (ii) an ultrasonic blasting tool, (iii) a powder blasting tool, (iv) radioactive tracers, (v) magnetic particles, and (vi) a chip inserter.

While FIG. 8 describes an embodiment of a method according to the present disclosure for extracting and testing a fluid or a core sample, and FIG. 9 describes an embodiment of a method according to the present disclosure for encapsulating a core sample, in some embodiments, the method may include extracting a fluid, testing the fluid or the core sample, and encapsulating the core sample.

Figure 10:
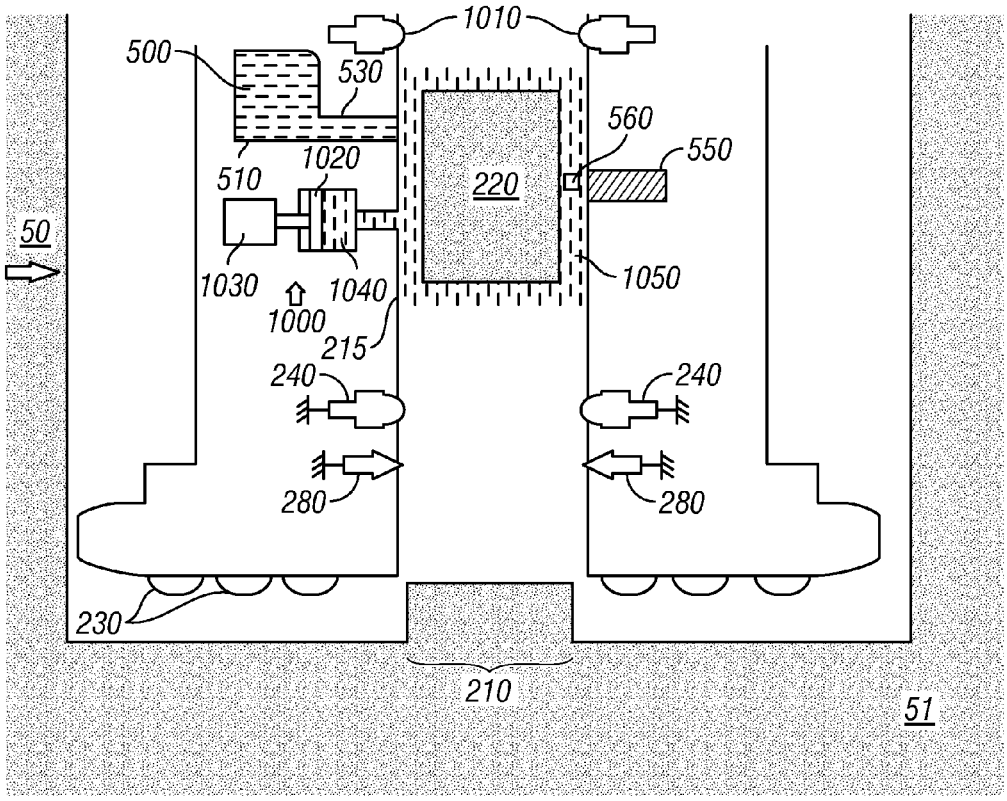
FIG. 10 shows a schematic of a drill bit configured for pressurizing a core sample according to one embodiment of the present disclosure.

FIG. 10 shows another exemplary embodiment of drill bit assembly 50 configured with to at least partially encapsulate a core sample 220 in a chamber 215 with an encapsulating material 500 while the chamber 215 is pressurized. A second set of seals 1010 may be located near the top of chamber 215 such that, when seals 1010 and seals 240 are closed, a section of chamber 215 holding core sample 220 is isolated from storage chamber 610 (FIG. 6). While the core sample 220 is isolated, any fluid 1050 in chamber 215 may be pressurized by a pressure applicator 1000. In this example, pressure applicator 1000 may include a force applicator 1030 piston 1020, and cylinder 1040 where force applicator 1030 is configured to move piston 1020 to reduce the combined volume of chamber 215 and cylinder 1040 resulting in increased pressure within chamber 215. Increasing the pressure on the core sample 220 may intensify pore pressure within the core sample 220. Pressure may be reduced or returned to ambient pressure by moving piston 1020 to increase the combined volume of chamber 215 and piston cylinder 1040. After pressure has been reduced, the core sample 220 may be encapsulated as shown above. In some embodiments, encapsulating material 500 may be applied to the core sample 220 while the pressure in chamber 215 is above ambient pressure. Encapsulating material 500 may be stored in reservoir 510 at a pressure sufficient to allow encapsulating material 500 to enter chamber 215, or a mechanism (not shown), such as a pump, may be used to increase the pressure of the encapsulating material 500 such that it may flow out of tube 530 against the pressure in chamber 215. The use of a piston and cylinder to modify the pressure in chamber 215 is exemplary and illustrative only, as other mechanisms, such as, but not limited to, a drilling fluid pressure, adjustable bladders, pumps, and displacement devices may be used to modify the pressure in chamber 215.

While the foregoing disclosure is directed to the one mode embodiments of the disclosure, various modifications will be apparent to those skilled in the art. It is intended that all variations be embraced by the foregoing disclosure.

I claim:

1. An apparatus for encapsulating a sample in a wellbore, comprising:

a drill bit configured to form a core;

a chamber configured to receive the sample from the core;

an encapsulater operably coupled to the chamber and configured to at least partially encapsulate at least part of the sample in an encapsulating material; and a pressure applicator increasing a pressure on the sample before the sample is at least partially encapsulated.

2. The apparatus of claim 1, wherein the encapsulating material is at least one of: (i) a polymer, (ii) a gel, (iii) a metallic coating, and (iv) a clay.

3. The apparatus of claim 1, wherein the encapsulating material is easily distinguishable from drilling fluid and unencapsulated materials from the wellbore.

4. An apparatus of claim 1, further comprising:

at least one retractable cutter internal to the drill bit configured to cut the sample from the core.

5. A method for encapsulating a sample in a wellbore, comprising:

using a drill bit in the wellbore for forming a core;

using a retractable cutter internal to the drill bit for cutting a sample from the core and conveying the sample to a receiving chamber;

using a pressure applicator to increase a pressure on the sample; and using an encapsulater operably coupled to the receiving chamber for at least partially encapsulating at least part of the sample in an encapsulating material after pressure has been increased on the sample.

6. The method of claim 5, using, as the encapsulating material, at least one of: (i) a polymer, (ii) a gel, (iii) a metallic coating, and (iv) a clay.

7. The method of claim 5, further comprising:

marking the encapsulating material using a tagging device.

8. An apparatus for encapsulating a sample in a wellbore, comprising:

a drill bit configured to form a core;

a chamber configured to receive the sample from the core;

an encapsulater operably coupled to the chamber and configured to at least partially encapsulate at least part of the sample in an encapsulating material; and a pressure applicator varying a pressure on the sample in the chamber.

9. The apparatus of claim 8, further comprising a storage module receiving the sample from the chamber; and at least one seal selectively isolating the storage module from the chamber.

10. The apparatus of claim 8, further comprising a fluid analysis module receiving a fluid from the sample before encapsulation, the fluid analysis module estimating at least one parameter relating to the extracted fluid.

11. An apparatus of claim 8, wherein the encapsulater is configured to at least partially encapsulate the sample while the sample is pressurized by the pressure applicator.

* * * * *